US006679190B1

(12) United States Patent
French et al.

(10) Patent No.: US 6,679,190 B1
(45) Date of Patent: Jan. 20, 2004

(54) FABRIC HOLDER FOR EMBROIDERY FRAMES

(76) Inventors: Nick L. French, 571 Watson Rd., Erlanger, KY (US) 41018; Mark E. Mason, 6286 Lesourdsville Westchester Rd., Hamilton, OH (US) 45011; Vytenis J. Viltrakis, 1027 Highland Ave., Ft. Thomas, KY (US) 41075

( * ) Notice: Subject to any disclaimer, the term of this patent is extended or adjusted under 35 U.S.C. 154(b) by 0 days.

(21) Appl. No.: 10/017,562

(22) Filed: Dec. 14, 2001

Related U.S. Application Data

(63) Continuation-in-part of application No. 09/872,946, filed on Jun. 1, 2001, now Pat. No. 6,394,012.

(51) Int. Cl.[7] ..... D05C 9/04
(52) U.S. Cl. ..... 112/103
(58) Field of Search ..... 112/121, 103, 112/470.18, 470.14, 475.11, 475.18; 38/102.2; 156/93; 160/380; 101/127.1

(56) References Cited

U.S. PATENT DOCUMENTS

| | | | | | |
|---|---|---|---|---|---|
| 3,664,288 | A | | 5/1972 | Von Boden et al. | 112/103 |
| 3,730,116 | A | * | 5/1973 | Schramayr | 112/470.14 |
| 4,598,488 | A | | 7/1986 | Inteso | 38/102.3 |
| 4,981,092 | A | | 1/1991 | Bauman et al. | 112/103 |
| 4,993,333 | A | | 2/1991 | Moore, III | 112/103 |
| 5,000,103 | A | | 3/1991 | Beermann | 112/121.12 |
| 5,005,501 | A | * | 4/1991 | Kita | 112/102.5 |
| 5,101,746 | A | | 4/1992 | Frye | 112/121.12 |
| 5,237,941 | A | | 8/1993 | Kraft et al. | 112/103 |
| 5,261,338 | A | | 11/1993 | Tajima et al. | 112/103 |
| 5,546,877 | A | | 8/1996 | Moore | 112/103 |
| 5,590,613 | A | | 1/1997 | Head | 112/103 |
| 5,651,325 | A | | 7/1997 | Conley, Jr. | 112/470.14 |
| 5,664,350 | A | | 9/1997 | Moore, III | 38/102.2 |
| 5,915,315 | A | | 6/1999 | Bentz | 112/103 |
| 5,937,774 | A | * | 8/1999 | Hayashi | 112/103 |
| 6,109,194 | A | | 8/2000 | Farb | 112/103 |
| 6,152,056 | A | | 11/2000 | Ulerich et al. | 112/103 |
| 6,227,129 | B1 | * | 5/2001 | Parker, Jr. | 112/475.18 |
| 6,240,863 | B1 | * | 6/2001 | Vickroy et al. | 112/465.18 |
| 6,298,800 | B1 | * | 10/2001 | Gala | 112/103 |
| 6,336,416 | B1 | * | 1/2002 | French et al. | 112/103 |
| 6,382,116 | B2 | * | 5/2002 | Wakasugi | 112/103 |
| 6,394,012 | B1 | * | 5/2002 | French et al. | 112/103 |

* cited by examiner

*Primary Examiner*—Ismael Izaguirrre
(74) *Attorney, Agent, or Firm*—Womble Carlyle Sandridge & Rice, PLLC

(57) ABSTRACT

A fabric holder of the type that attaches to a carriage of an embroidery machine and positions an embroidery frame in position relative to an embroidery platform, including a base, and multiple fabric clamping frame sets, each of the clamping frame sets having a lower clamping member and an upper clamping member mounted for movement between a closed position and an open release position. The lower clamping member and the upper clamping member of a selected set are releasably attached to the fabric holder.

1 Claim, 9 Drawing Sheets

FABRIC HOLDER FOR EMBROIDERY FRAMES

RELATED APPLICATIONS

This application is a continuation-in-part of application Ser. No. 09/872,946, file date Jun. 1, 2001 now U.S. Pat. No. 6,394,012 the contents of which is incorporated herein by reference in its entirety.

FIELD OF THE INVENTION

The present invention relates to the field of embroidery operations, and, more particularly to an improved device for holding small items to be embroidered during such operations.

BACKGROUND OF THE INVENTION

In the sewing and embroidery industry, fabric holding clamps, templates, and hoops are widely used for holding individual work pieces on single and multi-head embroidery machines. These devices are numerous, due in large part to the broad range of frame sizes and shapes that an embroidery operation must procure and maintain for different types of apparel and embroidery designs. Conventionally, each fabric holding device has been constructed as a unitary device having a defined embroidery opening. Thus, even though only the shapes and sizes of embroidery frames need to be varied to meet the spectrum of apparel and embroidery designs, embroiderers have heretofore been forced to purchase an entire fabric holding assembly. At hundreds of dollars per configuration in some cases, the cost of running a diversified embroidery operation quickly becomes prohibitive.

A related problem is that there are a number of different manufacturers and models of automated embroidery machines on the market and in use. For example, Tajima, Melco, Barudan, SWF, Brother, and Toyota each produce such machines. While certain features are similar, such as the general manner in which embroidery devices are mounted, these machines are neither designed nor constructed to have commonly-shaped mounts and are thus not capable of accepting fabric holding devices (frames) from other models. This means that an embroidery operation at the present time must limit itself to one model, or must purchase multiple frames of the same size and type for each of the different models in use. As a result, the embroidery company must carry a different frame, albeit identical in size and shape to another one already on hand, for each different make of machine.

An additional problem in the sewing industry associated with fabric holding devices is that, particularly for automated multi-head machines, these devices are pneumatically operated. While pneumatic controls provide some convenience for long runs, they are not conducive to operations that require frequent changing of fabric holding devices for the performance of different jobs, such as runs of small lots.

SUMMARY OF THE INVENTION

The present invention is directed to a fabric holding device for embroidery machines that addresses these problems. The holding device of the present invention is provided with interchangeable clamping frame sets of various shapes and sizes to be compatible with a spectrum of apparel types and embroidery designs.

A first aspect of the present invention is to provide a fabric holding device that is capable of releasably receiving a variety of interchangeable clamping frame sets. In a preferred embodiment of the present invention, the holding device does not have permanently formed or permanently affixed embroidery frames. Rather, the fabric holding device is constructed to permit the attachment and removal of upper and lower clamping members.

The holding device includes a base that has a stationary lower portion and a pivotally attached upper portion. The stationary lower portion releaseably attaches the lower clamping member, the shape and size of the lower clamping member defining a first embroidery area. Retaining lugs formed or applied to the upper surface of the central area slideably engage opposed side edges of the lower clamping member. One or more pins or alignment devices (not shown) may also be formed on or applied to the upper surface of the base portion for proper alignment of the lower clamping member of the selected embroidery frame. At least one retainer is provided to secure the lower clamping member to the central area so that it remains in place during embroidery operations. The upper portion is pivotally fastened to walls on opposed sides of the lower portion. The upper portion includes opposed arms that extend forwardly. Inwardly directed pins, or other flexible holders are formed in the outer ends of the arms for releasably and pivotally holding an upper clamping member. The upper clamping member defines an embroidery opening corresponding approximately in size and shape to the embroidery opening of the lower clamping member of the fabric clamping frame set. When the pivotally attached upper portion is pivoted to the closed position, the two clamping members are in approximate registration with one another.

While the fabric holding device may be used with pneumatically operated clamping sets, it is preferably used with a manually operable embroidery clamping frame for holding an article to be embroidered using automated embroidery equipment. In a preferred embodiment, the fabric holding device includes upper and lower clamping members which are moveable from the open to closed position manually rather than pneumatically. A manual clamping mechanism is provided in which the upper clamping member is pivotally attached to and normally biased toward closed gripping contact with the lower clamping member. This is achieved in part by attaching a spring between the upper clamping member and the base. A lever mechanism engages the clamping member to provide the mechanical advantage to overcome the spring bias and open the clamping frame so that the embroidered article may be positioned or removed.

All models contain mounting arms that extend outwardly from the clamping mechanism. Although the embroidery stations of the different models are generally the same width in currently available models, the outer edges of the mounting arms for different models are uniquely shaped for mating engagement with a single make of automated embroidery machine. The present invention is very useful in such machines, however, the greatest flexibility is achieved when the fabric holding device of the present invention is adapted to be interchangeable with at least several makes of embroidery machines. To accomplish this the mounting arms must be configured differently at the outer ends. One way of accomplishing this is to make the entire mounting arm replaceable. However, more preferably, the mounting arms are provided with adaptor plates at the outer ends thereof.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1:
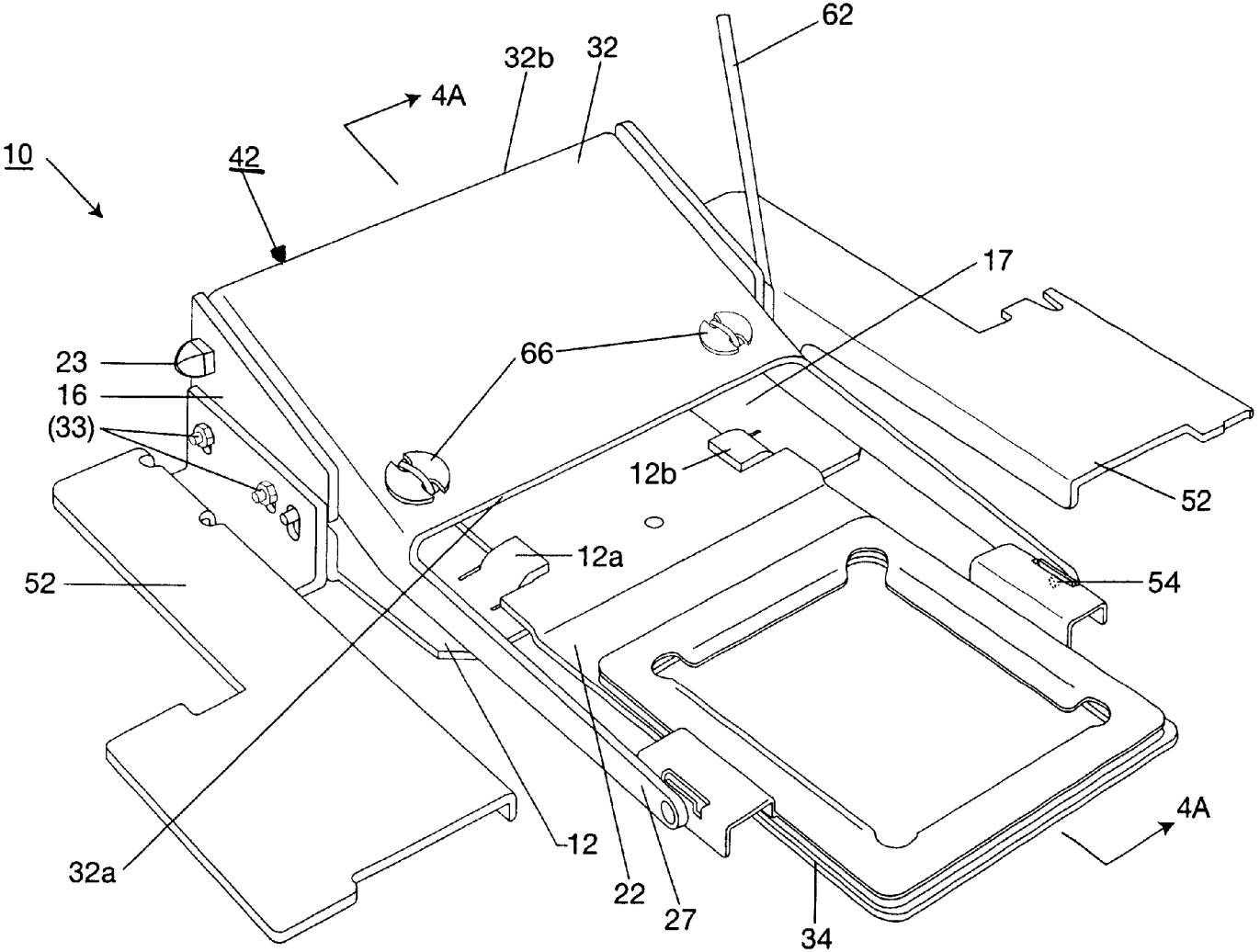
FIG. 1 is a left front perspective view of the fabric holder of the present invention with the upper and lower clamping members in the closed position.
Figure 2:
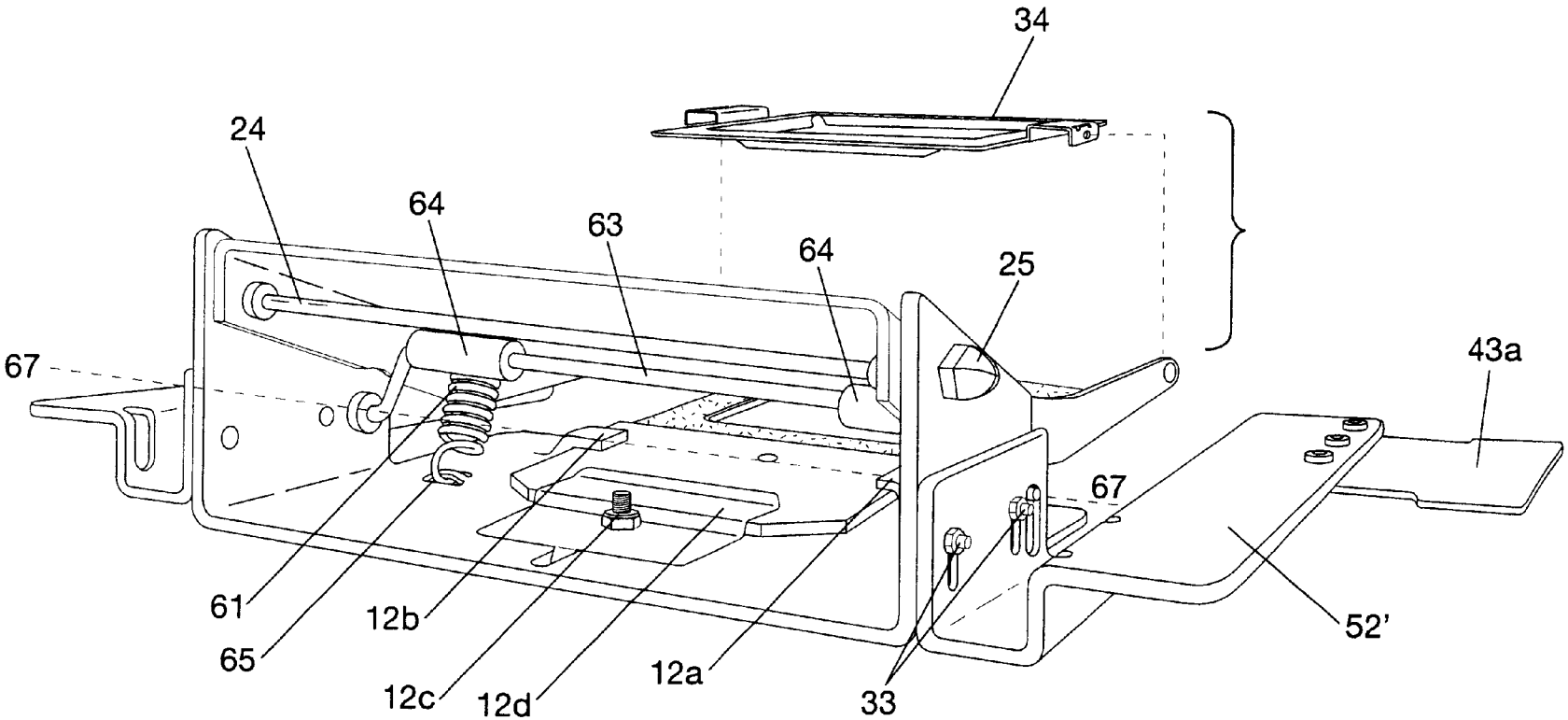
FIG. 2 is a right rear exploded perspective view of the fabric holder of FIG. 1.

As shown in FIG. 1, the present invention is directed to a fabric holder of the type that attaches to an automated embroidery machine and positions an embroidery frame in position relative to an embroidery platform. Shown generally as 10, the fabric holder includes a lower base portion 12, a releasably attachable lower clamping member 22, an upper base portion 32 pivotally attached to the lower base portion, a releasably attachable upper clamping member 34, a manual clamping mechanism 42, and mounting arms 52. The upper clamping member 34 and lower clamping member 22 comprise a fabric clamping frame set of the type envisioned by the present invention. FIGS. 1 and 2 are illustrative of the fabric holder of the present invention, adaptable to an SWF embroidery machine, in an closed position; i.e., the lower clamping member 22 and upper clamping member 34 are in closed contact with one another.

An aspect of the present invention is to provide a fabric holder that is adaptable to releasably receive a fabric clamping frame set of a selected size and shape; i.e., having interchangeable embroidery frames. In a preferred embodiment, lower base portion 12 has opposed side edges 15 and a central, substantially flat area 17 that is adapted to releasably receive lower clamping member 22. Walls 16 extend upwardly from at least some portion of side edges 15. Walls 16 are integrally formed with lower base portion 12, but may be separately affixed.

Figure 5A:
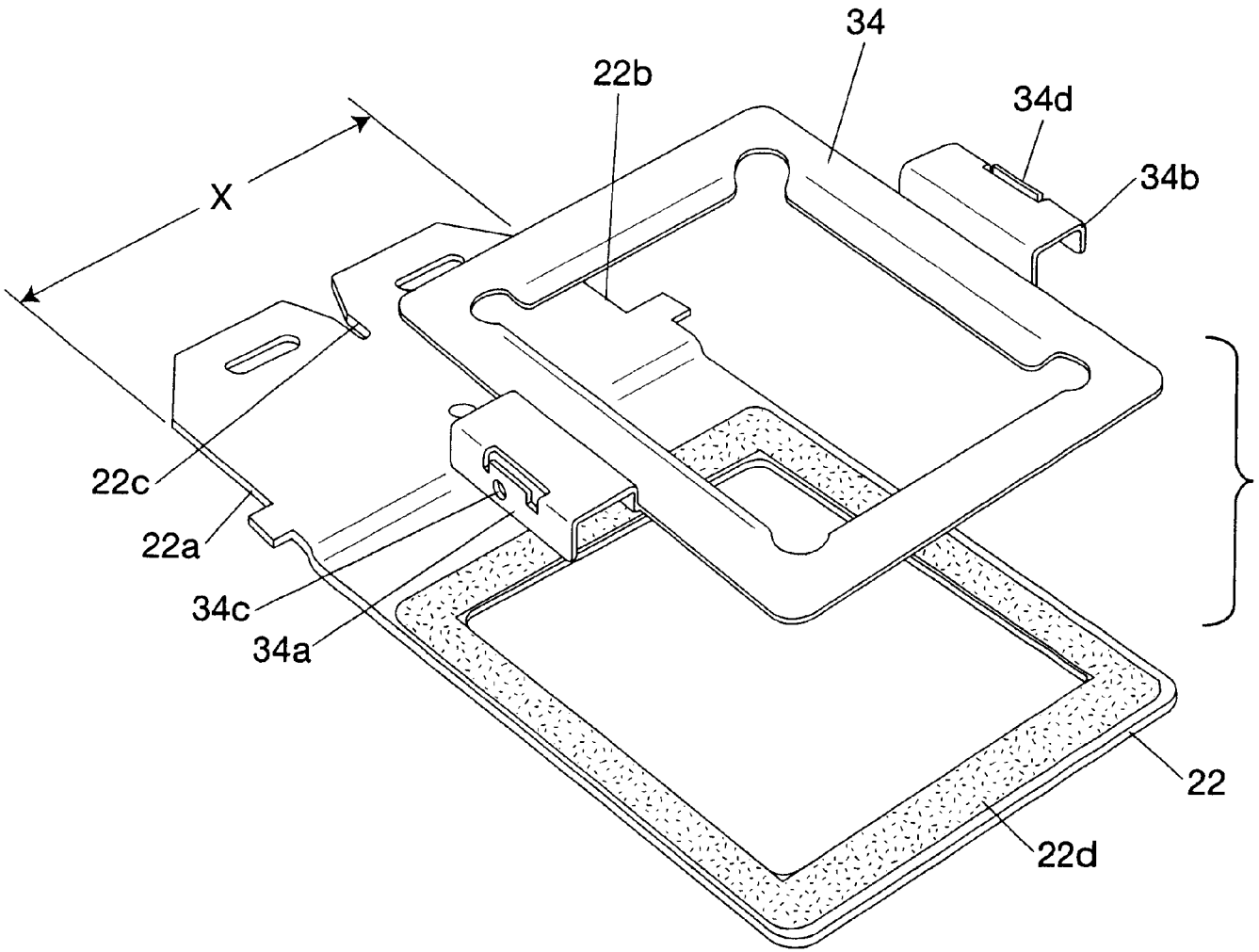
FIGS. 5A–5C are exemplary of embroidery frame shapes and sizes adaptable to the fabric holder of the present invention.
Figure 5B:
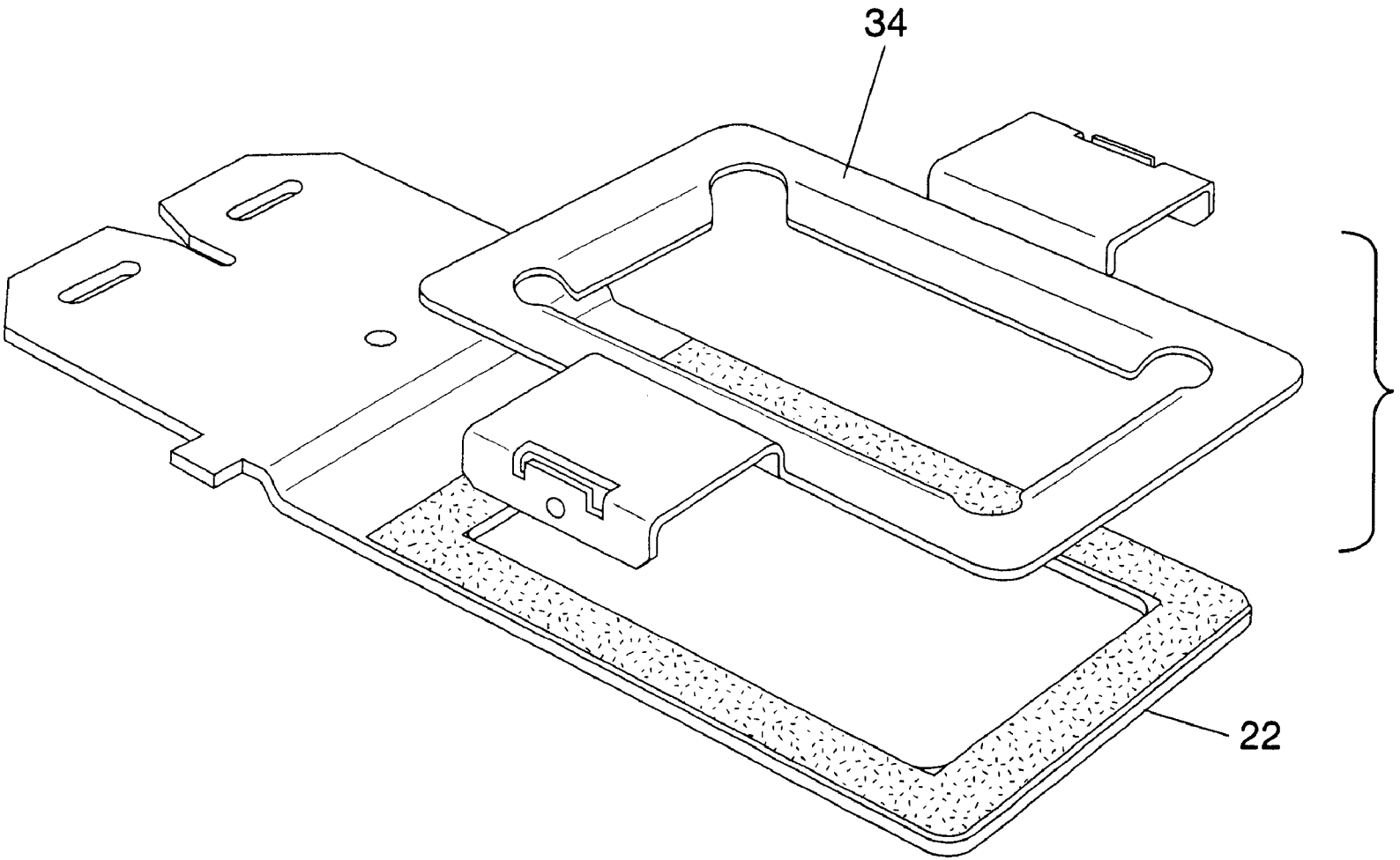
Figure 5C:
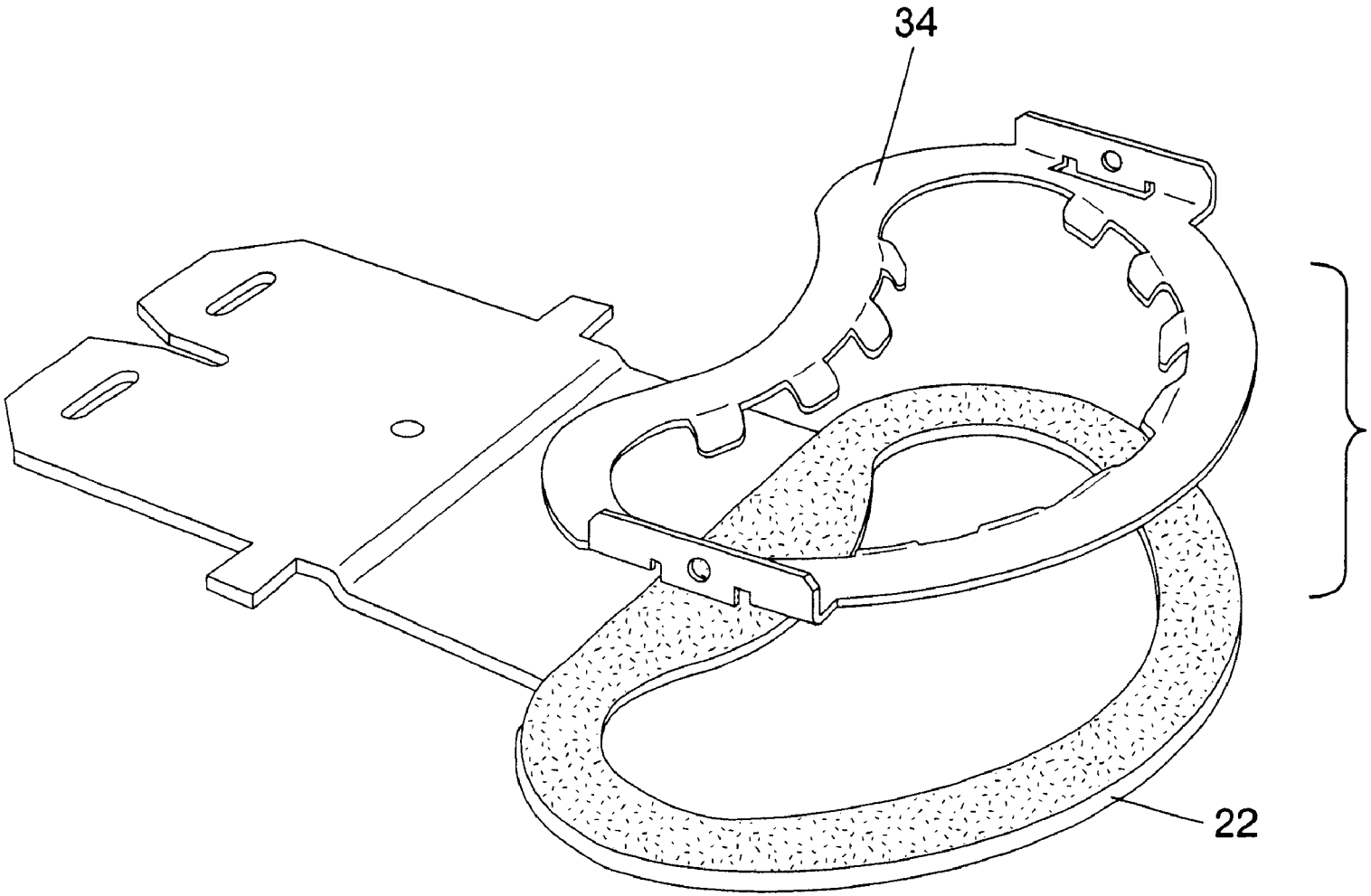

The lower clamping member 22 of the fabric clamping frame set is releasably attachable to lower base portion 12. FIGS. 5A through 5C are illustrative, though not exhaustive, of typical fabric clamping frame sets that are interchangeably mounted to fabric holder 10. The frame sets shown in FIGS. 5A through 5C are only several typical configurations of many possible applications. While they differ in shape and size, the frame sets share common features. Each fabric clamping frame set comprises a lower clamping member 22 and an upper clamping member 34. Lower clamping member 22 is a rigid metallic frame defining a first embroidery opening. A non-slip material 22D such as rubber or sandpaper is affixed about the upper peripheral surface of the embroidery opening to engage an item being embroidered.

Figure 4A:
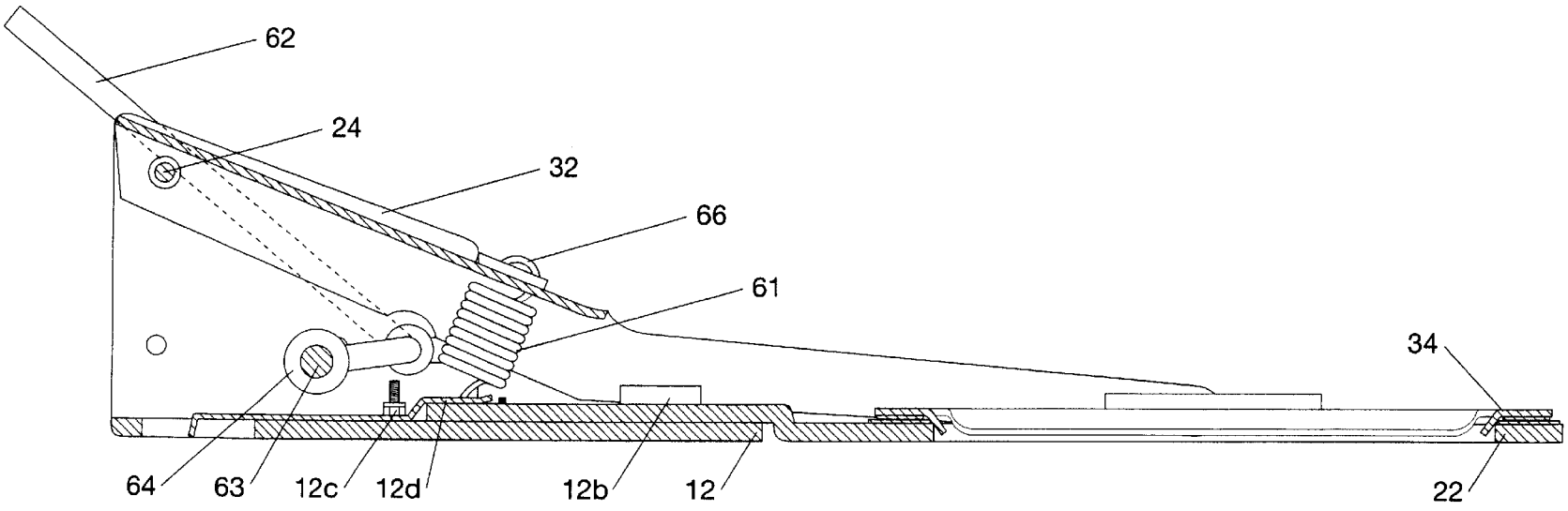
FIG. 4A is a sectional view of the fabric holder of FIG. 1 along line 4—4 with the fabric holder in the closed position.
Figure 4B:
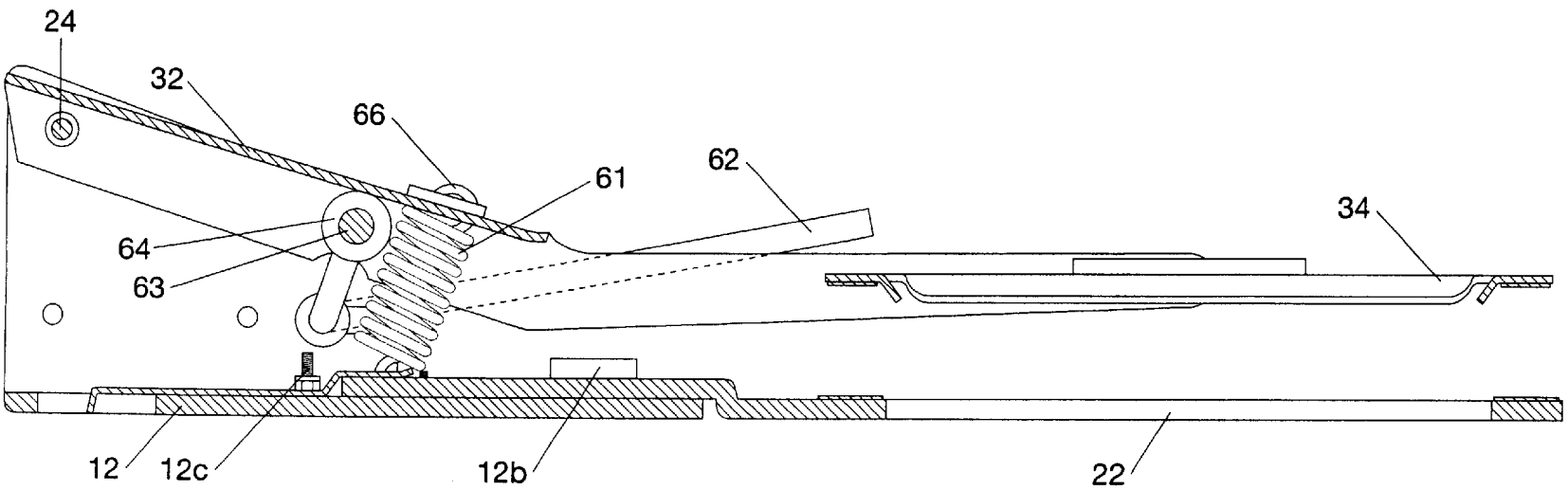
FIG. 4B is a sectional view of the fabric holder of FIG. 1 along line 4—4 with the fabric holder in the open position.

As best shown in FIGS. 4A and 4B, the rear, or attached, end of the lower clamping member is "stepped up" from the front, or frame, portion of the clamping member. The step between the front and rear of the lower clamping member 22 serves as a stop and as an alignment aid when the lower clamping member is attached to the lower base portion 12. Each lower clamping member, regardless of size or shape, will have substantially parallel opposed side edges 22A, 22B that are slideably received through opposed receiving lugs 12A, 12B formed on, or attached to, flat area 17 of lower base portion 12. The distance between opposed lugs 12A, 12B is approximately the same as the distance between opposed side edges 22A, 22B, shown in FIG. 6A as dimension X. To ensure proper alignment and for firmly securing lower clamping member 22 to lower base portion 12, a slot 22C is centrally formed in the rear end of the lower clamping member 22. Slot 22C engages a pin 12C projecting upwardly from lower base portion 12. Additionally, a retainer 12D is provided having a rear portion adjacent the central area 17 and a front raised portion adjacent the upper surface of lower clamping member 22. Retainer 12D assists in holding the lower clamping member 22 on area 17 in place during usage. Tightening of the bolt and nut 12C increases the gripping pressure brought to bear by retainer 12D against the lower clamping member 22.

Upper base portion 32 is pivotally mounted to lower base portion 12 between walls 16 with an elongate rod 24 having threaded ends and extending through the rear of walls 16 and through side walls of upper base portion 32. Nuts 25 hold the rod 24 in position through walls 16 and through upper base portion 32. Alternatively, separate fasteners may pivotally secure each wall 16 to opposed sides of upper base portion 32. Upper base portion 32 includes opposed front and rear ends 32A, 32B and opposed side edges 26. As shown in FIGS. 1 and 2, the front portion of upper base portion 32 slopes forwardly and downwardly from rear end 32B. In this embodiment, the forwardly sloping upper base portion 32 provides a lower profile (height) than conventional pneumatically driven fabric holders, enabling the fabric holder 10 of the present invention to be adaptable to even more makes of automated embroidery machines.

Arms 27, integrally formed with base portion 32, extend forwardly from each of the opposed side edges 26. A releasably attachable upper clamping member 34 of a selected fabric clamping frame set is pivotally attached between arms 27. Pins 54 are affixed to each of arms 27 and project inwardly a sufficient distance for engaging and holding upper clamping member 34 during the embroidery operation. As shown in FIGS. 1 and 2, one selected upper clamping member 34 is generally rectangularly shaped, defining a second embroidery opening therethrough. The size and shape of the embroidery opening formed therethrough is varied with the type and size of item to be embroidered. The embroidery opening created by upper clamping member 34 is dimensioned so that it is substantially the same size and orientation as the first embroidery opening and in registration with the first embroidery opening defined by the lower clamping member 22, when the two are in closed contact. Referring again to FIGS. 5A through 5C, upper clamping member 34 has extensions 34A and 34B extending outwardly from opposed sides of the upper clamping member. Extensions 34A and 34B are substantially coplanar with the upper surface of member 34 and have downturned flanges at their outer edges with generally circular apertures 34C, 34D formed therethrough. Apertures 34C, 34D are located and dimensioned for mating engagement with pins 54 on opposed arms 27. Arms 27 have some lateral flexibility, therefore they may be flexed outward to permit the upper clamping member with apertures 34C and 34D to pivotally engage and be held in position by pins 54.

Preferably the present invention is used with a manually operable embroidery clamping frame for holding an article to be embroidered using automated embroidery equipment. A manual clamping mechanism 42 is provided to maintain the lower clamping member 22 and upper clamping member 34 in positive closed contact. As used herein "positive closed contact" refers to a pressure exerted between the article holding surfaces that is sufficient to prevent slippage under expected operating conditions for automated embroidery machines. In the preferred embodiment, manual clamping mechanism 42 is comprised of tension springs 61, levers 62 and 63, and rollers 64. Springs 61 are attached to lower base portion 12 through slots 65 in base 12 and extend between slots 65 and the front end of upper base portion 32 where they attach through holes to spring retainers 66. Those skilled in the art will appreciate the numerous ways in which the ends of tension springs 61 could be fastened. Springs 61 tensionally bias the front end of upper base portion 32 and attached upper clamping member 34 downwardly into closed contact with lower clamping member 22. The amount of tensional holding force exerted is dependent upon the spring constant chosen for springs 61.

As shown in FIGS. 2, 4A, and 4B, levers 62 and 63 are integrally formed and connected through a common fulcrum axis 67 formed through walls 16. Lever 62 is formed with a handle portion having an end bent at a right angle for insertion through fulcrum 67. The handle portion is of sufficient length to provide a mechanical advantage over springs 61. As shown in FIG. 4A, the handle portion of lever 62 is normally in a vertical orientation when lower clamping member 22 and upper clamping member 34 are in closed contact. Lever 63, formed through a right angle with lever 62 is in a generally horizontal orientation. Rollers 64 surround portions of lever 63 to provide for upward rollable movement of lever 63 against upper base portion 32 when lever 62 is manually pulled to the forward horizontal position shown in FIG. 4B. In operation, when lever arm 62 is pulled forwardly and downwardly, lever 63 with rollers 64 is pivoted and urged upwardly and forwardly against upper base portion 32. This mechanical displacement overcomes the spring bias and causes upper clamping member 34 to pivot upwardly and springs 61 to stretch. The upward pivot of upper base portion 32 causes upper clamping member 34 to disengage from contact with lower clamping member 22. When lever arm 62 is pushed upwardly and rearwardly, the exact opposite occurs. The energy in springs 61 aids in pivoting upper clamping member 34 downward in closed contact with lower clamping member 22.

Figure 3:
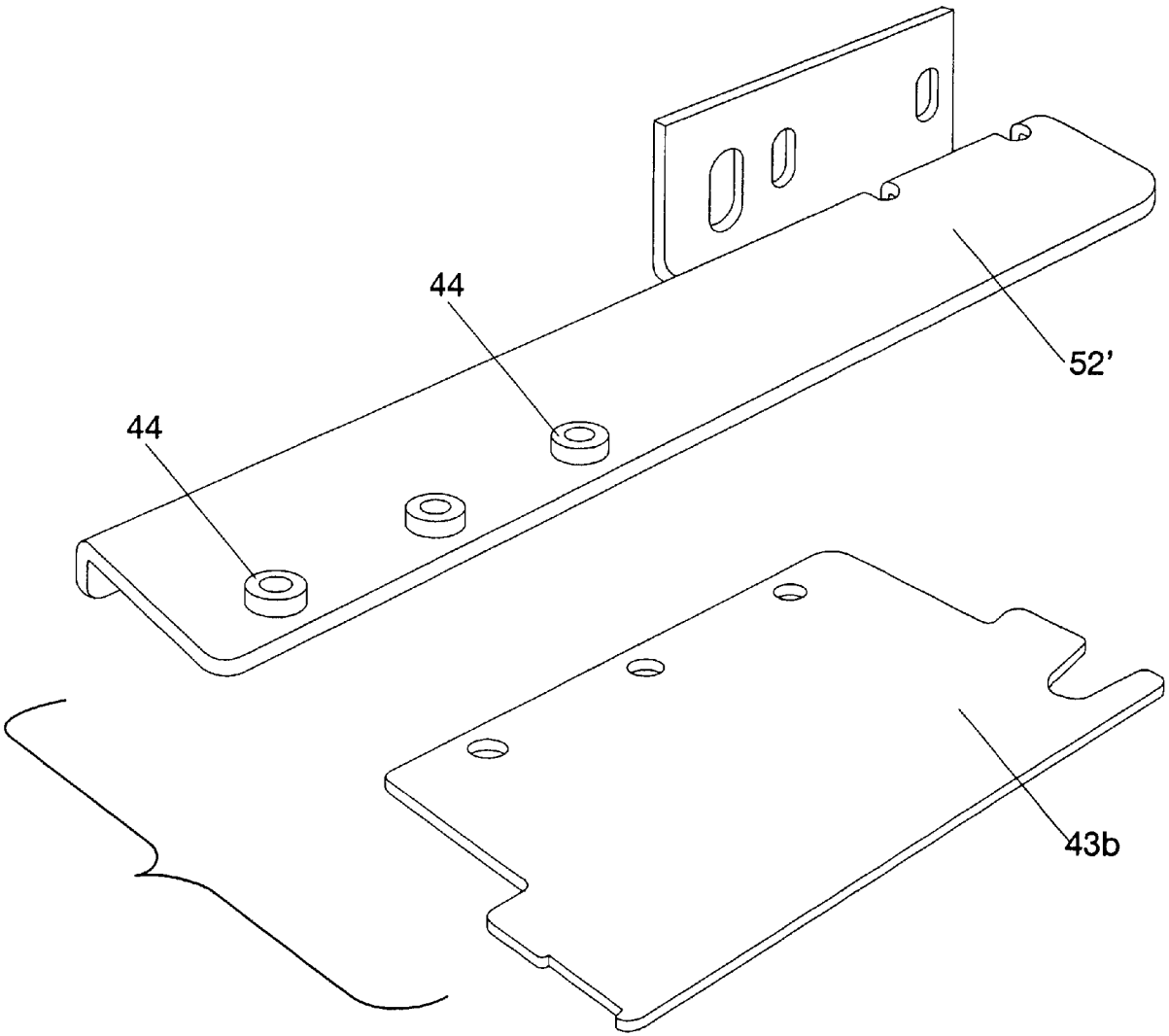
FIG. 3 is an exploded view of a mounting arm and adapter plate for a Melco embroidery machine.

Referring again to FIG. 1, mounting arms 52 are attached to and extend outward from lower base portion 12. Mounting arms 52 are separately fastened to lower base portion 12 with fasteners 33 conventional in the art, such as machine screws, bolts, etc., but alternatively may be integrally formed with lower base portion 12. While not critical to the invention, fabric holder 10 may be mounted to any model of automated embroidery machine without the need to move or alter any features or hardware, such as pneumatic hoses, from the embroidery machines. By using different configurations on the extremities of the arms 52, the mounting arms 52 may be interchanged to fit different models of automated embroidery machines. In a preferred embodiment of the invention, adaptor plates are mounted on the end of arms 52, 52' to adapt the embroidery frame to fit various models of machines. Referring to FIGS. 2 and 3, fabric holder 10 is shown with mounting arms 52' that, similar to the first aspect, attach to and extend generally outward from base 12. However, mounting arms 52' are dimensioned to receive adapters. Shown as 43A and 43B, adapters (shown here for an SWF machine) are selectively chosen to matingly engage with a particular model of embroidery machine. As best seen in FIG. 3, arm 52' has a series of threaded holes 44 that are formed in its outer ends. Adapters 43A and 43B are easily attached to arms 52' with threaded fasteners (not shown). When attached together, fabric holder 10 is ready to be mounted on the selected embroidery machine.

Figure 6:
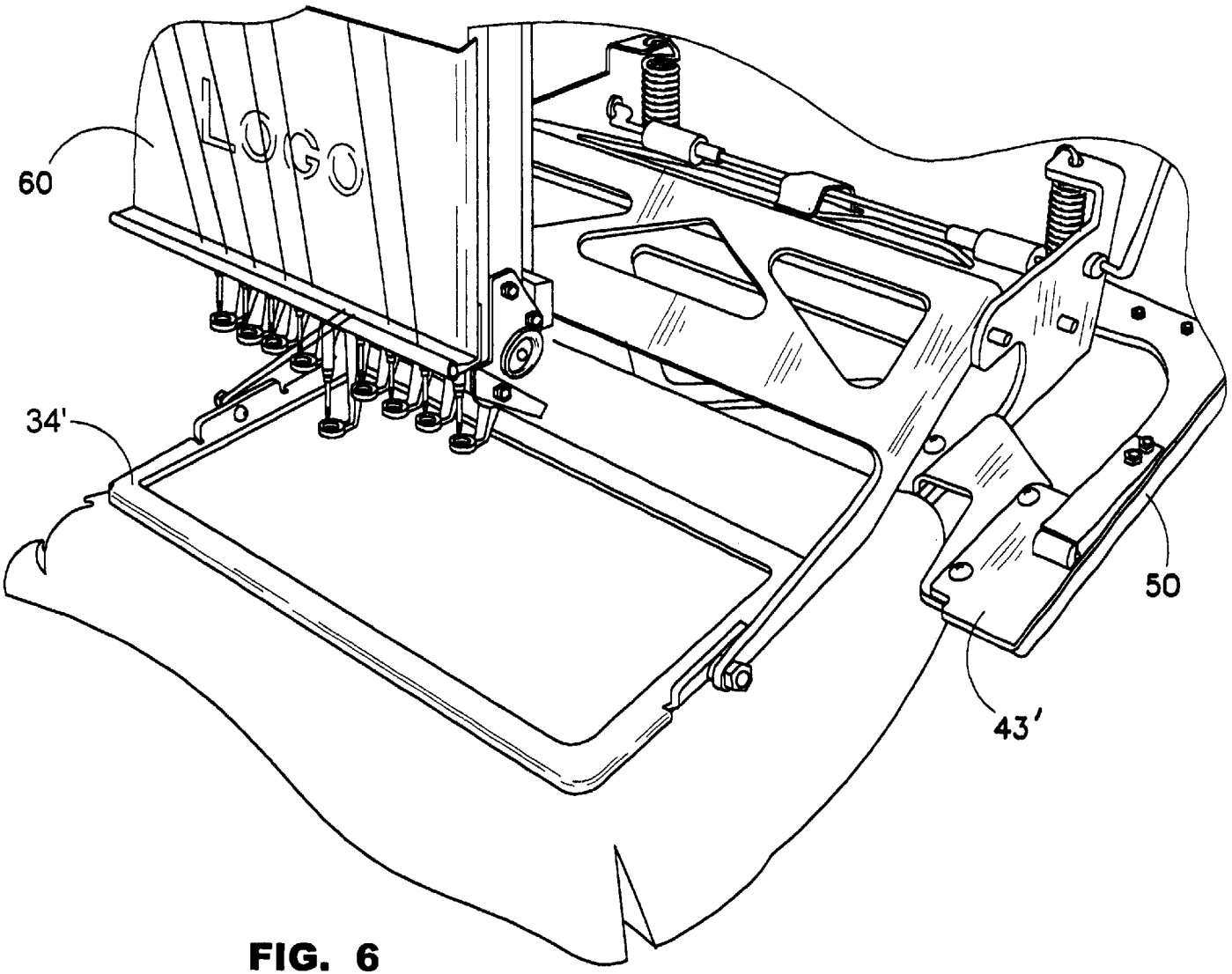
FIG. 6 is an environmental view illustrating how a manual fabric holder is installed on a typical automated Brother embroidery machine.

FIG. 6 is an illustrative environmental view of one embodiment of fabric holder 10 mounted on a Brother machine and illustrating how upper clamping member 34' defines an upper embroidery opening for the embroidery head 60. Adapters 43' are received by the arms 50 of the mounting carriage of the machine to securely hold a fabric holder in place during embroidery operations. Arms 50 will, of course, vary in configuration, shape, and form of mating engagement from one model of machine to another, but the distance between the arms that form a station is substantially the same.

Although the present invention has been described with a preferred embodiment, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. In an embroidery machine fabric holder of the type having a base which includes a clamping set in which the fabric is held between an upper clamping member and a lower clamping member pivotally joined for movement between a first closed clamping position and a second open clamping position, the improvement comprising the lower clamping member and the upper clamping member both being releasably joined to the base so that different clamping sets can be attached to the same base for use with various types of apparel and/or embroidery design.

* * * * *